US005875490A

United States Patent [19]

Woodard et al.

[11] Patent Number: 5,875,490

[45] Date of Patent: Mar. 2, 1999

[54] PORTABLE DISPOSABLE BIB

[76] Inventors: Nina E. Woodard, 347 Varick St. 120A, Jersey City, N.J. 07302; Dorothy Mathews, 12607 Keswick St., North Hollywood, Calif. 91605

[21] Appl. No.: 950,375

[22] Filed: Oct. 14, 1997

Related U.S. Application Data

[60] Provisional application No. 60/028,612 Oct. 23, 1996.

[51] Int. Cl.[6] ..... A41D 27/00; A41B 13/10

[52] U.S. Cl. ..... 2/49.1; 2/48; 206/223; 206/581; 206/233; 206/38; 206/213; 206/812

[58] Field of Search ..... 2/46, 48, 49.1, 2/49.2, 49.3, 49.4, 49.5, 50, 51, 52, 75, 80, 83, 174, 114, 1; 53/133.5, 133.6, 133.7, 133.8, 219, 220, 241, 247, 462; 206/213, 223, 581, 229, 233, 38, 812

[56] References Cited

U.S. PATENT DOCUMENTS

| | | | |
|---|---|---|---|
| 2,164,369 | 7/1939 | Woolever | 2/49.1 |
| 4,332,319 | 6/1982 | Hurwood | 206/210 |
| 4,427,115 | 1/1984 | Laipply | 206/484 |
| 4,977,626 | 12/1990 | Smith | 2/50 |
| 5,046,620 | 9/1991 | Barabino | 206/581 |
| 5,241,710 | 9/1993 | Lockhart | 2/406 |
| 5,530,968 | 7/1996 | Crockett | 2/48 X |

*Primary Examiner*—Jeanette Chapman

[57] ABSTRACT

A package which provides the user with a disposable bib. The package is especially suited for transportation as it is hand-held and preferably sized to fit into an automobile's glove-box. In some embodiments of the invention, multiple bibs are dispensed from the package in a pop-up type of arrangement. In other embodiments of the invention, a cleansing wipe/sheet is provided with each bib so that the user is able to cleanse themselves (or if the bib is used on an infant, the user is able to cleanse the infant). A further feature, one embodiment of the invention provides a garbage bag so that debris generated during the meal is collected for disposal.

8 Claims, 2 Drawing Sheets

PORTABLE DISPOSABLE BIB

This is a continuation-in-part of U.S. Provisional patent application Ser. No. 60/028,612, filed Oct. 23, 1996, and entitled "A Portable Disposable Bib".

BACKGROUND OF THE INVENTION

This invention relates generally to bibs and more particularly to a portable disposable bib.

Often, a diner has need for a bib to protect their clothes from messy foods which are being eaten. Within restaurants, bibs are offered for such items as lobsters and crab legs. While this scenario is readily accepted, there are many other applications where a bib is desired.

People attempting to drive while eating or eating while flying, often spill food and drink onto their clothing. When the person arrives at their destination, they are then unkempt and do not present the image that they desire.

It is clear that there is a need for a handy dispenser of disposable bibs.

SUMMARY OF INVENTION

The invention provides a package containing at least one disposable bib. The bib is contained in a clean (preferably sterile state) within the package until ready for use. Once the bib has been used (either by an adult for such food items as lobster, or a child), the bib is disposed through the trash system.

As such, the invention is particularly well adapted for use in such diverse areas as: airlines, restaurants, in diaper bags, and with wheel-chairs.

The package of the invention is preferably hand-held and sized to fit into an automobile's glove-box. This permits the invention to be used in situations which heretofore have been difficult if not impossible.

In some embodiments of the invention, multiple bibs are dispensed from the package in a "pop-up" type of arrangement. In this embodiment, a box of bibs is placed at a location where they are commonly used (i.e. near the infant's high-chair). When the parent needs a bib, one is simply withdrawn from the box and placed around the infant's neck. Afterwards, the bib is discarded in the trash.

In other embodiments of the invention, a single bib is enclosed within the package. This embodiment allows the package to be extremely small and as such, easily carried for a single use. A packaged bib is then accessible for eating in restaurants where the package is dispensed to patrons.

In some embodiments of the invention, a cleansing wipe/sheet is provided with each bib so that the user is able to cleanse themselves (or if the bib is used on an infant, the user is able to cleanse the infant). The cleansing sheet is often impregnated with an alcohol (and sometimes also with a pleasant scent); this allows the cleansing sheet to readily remove oils and food particles from the user's face and to be used to cleanse the hands of the user.

A further feature, in one embodiment of the invention, provides a garbage bag so that debris generated during the procedure is easily collected for disposal. Ideally the garbage bag is sealable after the collection of the debris since a trash receptacle may not be convenient.

Within the embodiment using multiple bibs within the package, a stack of disposable bibs is created which are individually dispensed from a small box or container. The preferred box or container is on the order of 4 inches long by 2 inches wide by 1 inch thick. This size is particularly suited for inclusion in a purse or a vehicle's glove box.

The bibs are stacked within the container so that as one bib is removed, an edge of a second bib is exposed for easy "grabbing".

The bibs which are dispensed from this packaging are preferably made of thick absorbent cloth-like material in bib shape. A closure at the back of neck is provided. In the preferred embodiment, this closures includes a releasable glue which is positioned on one ribbon; the releasable glue end is then selectively attached to the other ribbon. When the user is finished, the ribbons are easily disconnected for discarding of the bib.

In one embodiment, the bibs are packaged in purse size tissue type packaging holding 4 or 5 of the bibs. In the preferred embodiment, each bib is imprinted with the tradename of the manufacturer for in car usage. In other embodiments, the tradename imprinted onto the bib is that of the restaurant or hotel dispensing the packages.

An alternative embodiment creates a single package which holds a single folded bib. The package is sterile so that the user is assured of a sanitary bib. The single bib package is particularly useful as an inclusion in airline meal utensil and condiments package for distribution with coffee "to go" orders.

The preferred bibs, packaged as indicated:

a) provide for easy storage in car, plane, purse;

b) are light weight;

c) are easy to put on due to the releasable glue;

d) are structured to "catch" drips, splashes, and light spills; and e) are disposable.

The invention, together with various embodiments thereof, will be explained in more detail by the accompanying drawings and following description.

DRAWINGS IN BRIEF

DRAWINGS IN DETAIL

Figure 1:
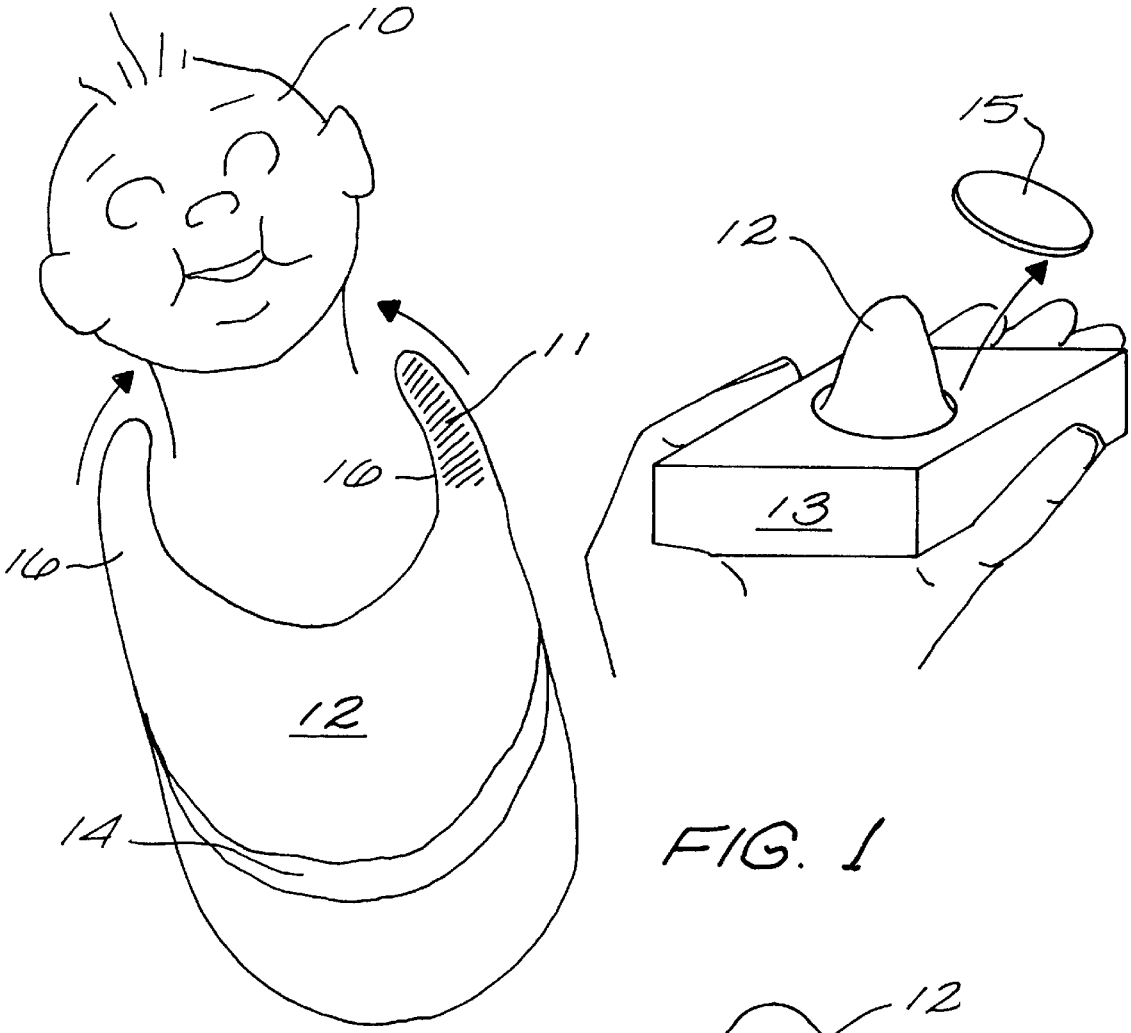
FIG. 1 illustrates a preferred embodiment of the bib being placed around the neck of a user.

FIG. 1 illustrates a preferred embodiment of the bib being placed around the neck of a user.

Bib 12 is dispensed from a pursed sized dispenser 13. To obtain the bibs, tab 15 is removed from dispenser 13 and individual bibs "pop-out" for withdrawal by user 10. Purse sized dispenser 13 allows the user to withdraw one of the bibs at a time and is conveniently sized to fit into an automobile's glove box or a purse.

Each bib 12 has two ribbon ties 16. One of the ribbon ties 16 has a releasable glue 11 affixed thereto. Glue 11 is releasable, allowing bib 12 to be readily secured, and, when bib 12 has served it's purpose, bib 12 is easily removed.

Spill envelope 14 assists in preventing food particles from falling away from bib 12 and into the lap of user 10.

Figure 2:
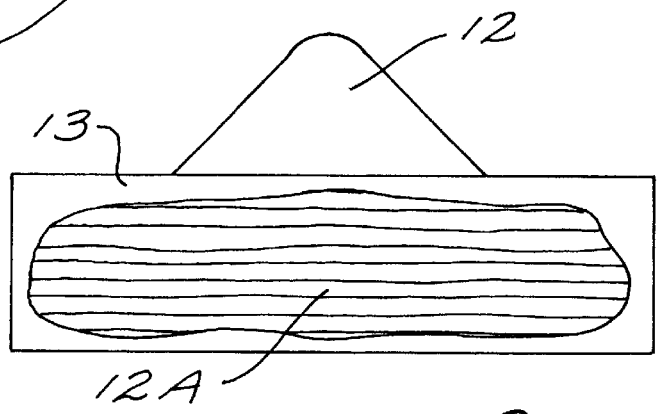
FIG. 2 illustrates the folding aspect of the preferred embodiment which shows the folded bibs within the dispenser.

FIG. 2 illustrates the folding aspect of the preferred embodiment which shows the folded bibs within the dispenser.

Dispenser 13 has a multitude of bibs 12 folded therein. Each of the bibs 12A are interlaced with the overlying bib so that as one is pulled from dispenser 13, another bib is pulled through the tab slot (not shown in this view).

This particular embodiment is especially useful for a kitchen environment allowing the parent to quickly and easily obtain a bib for the infant during meal-times.

Figure 3:
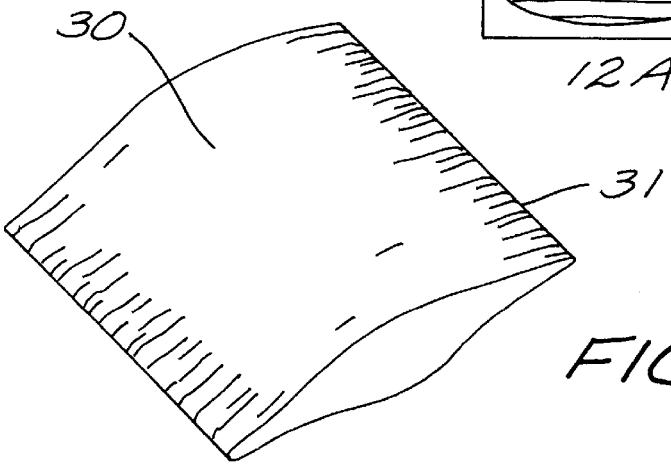
FIG. 3 is a perspective view of an embodiment of the invention in which a single bib is contained within a sterile package.

FIG. 3 is a perspective view of an embodiment of the invention in which a single bib is contained within a sterile package.

In some embodiments, a single bib is packaged so that it can be easily carried or dispensed by the restaurant or airline. In this embodiment, container 30 is sealed and has a sterile environment. The bib (not shown) contained within container 30 is preferably made of a very thin material to keep the size of container 30 at a minimum.

One such material which is suitable for this purpose is a plastic. Those of ordinary skill in the art readily recognize a variety of other materials applicable for manufacture of the bib.

The user tears end 31 of container 30 to reveal the enclosed bib.

In some embodiments, the contents of container 30 are maintained in a sterile condition through the application of an alcohol mist into container 30 during its manufacture. This alcohol mist prevents bacterial and viral growth within container 30.

Figure 4:
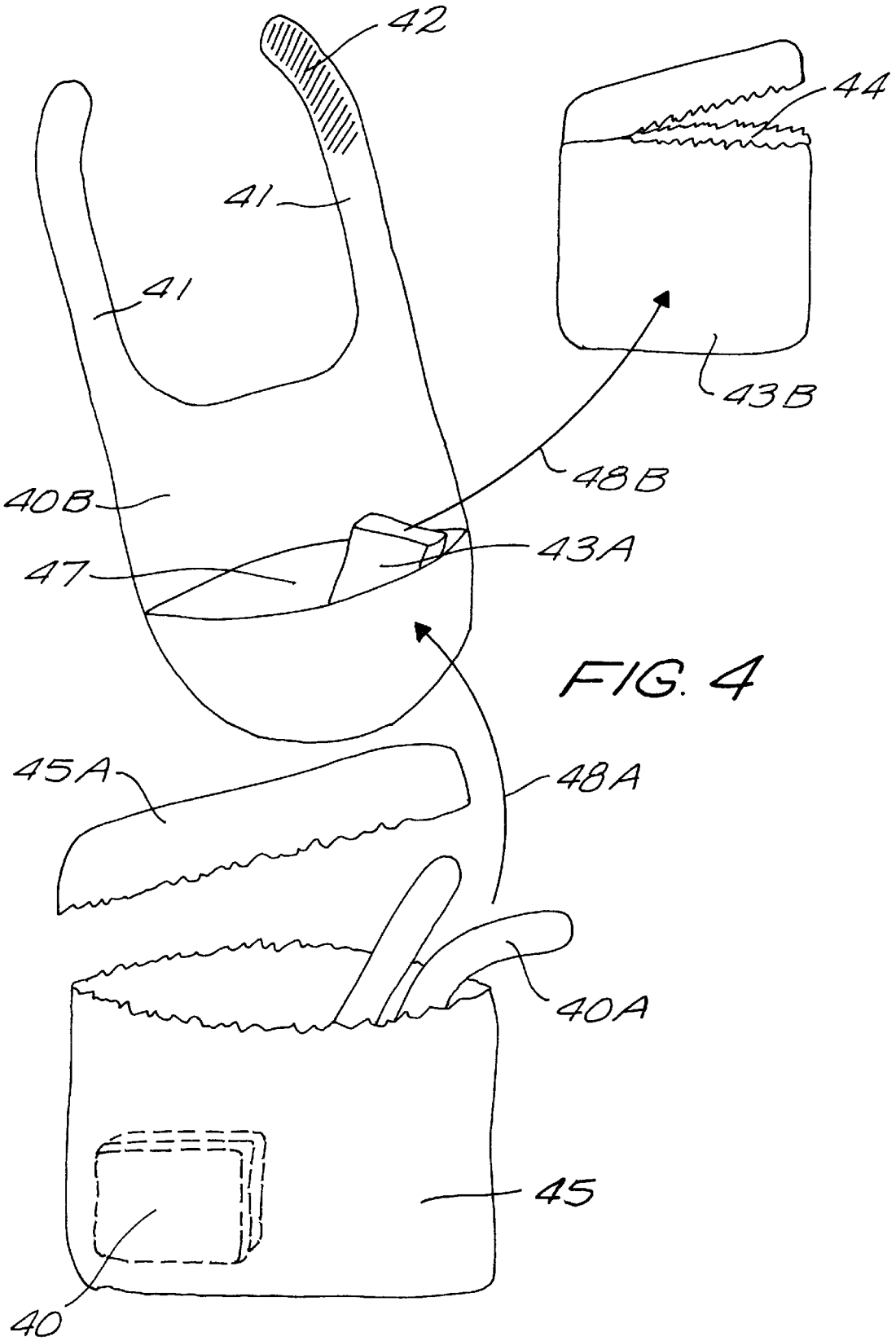
FIG. 4 is a perspective view of a single use embodiment in which the packaging includes the bib, cleansing sheet, and a garbage bag.

FIG. 4 is a perspective view of a single use embodiment in which the packaging includes the bib, cleansing sheet, and a garbage bag.

In this embodiment, package 45 contains the elements required by the user. Once package 45 is opened by removing top portion 45A, bib 40A is exposed and easily removed (as indicated by arrow 48A).

Removed bib 40B has two ribbon ends 41 wherein one of the ribbon ends has a releasable glue 42 placed thereon. In some embodiments of the invention, no glue is used; instead, ribbon ends 41 have sufficient length to be tied around the user's neck.

Within spill envelope 47 is sealed package 43A which is removable by the user as indicated by arrow 48B. Removed sealed package 43B is manually opened by the user to reveal the cleansing sheet 44. Cleansing sheet 44 is impregnated with a liquid so that the skin of user can be readily cleaned after the meal. Those of ordinary skill in the art readily recognize a variety of such liquids, including alcohol. In some embodiments, a liquid scent is also added to provide the user with a pleasing experience.

Once the user has completed his meal, in one embodiment of the invention, garbage bag 40 is retrieved from package 45. Garbage bag 40 is then unfolded and used to collect bib 40DB, package 43B, cleansing sheet 44, and any other debris.

In this embodiment, a single package provides the user with the facilities to keep the user clean during the meal, to clean the user's face and hands, and to dispose of the debris in an efficient manner.

It is clear that the present invention creates a highly useful and versatile bib carrying case and disposal system.

What is claimed is:

1. A dispensing package comprising:

a) a portable package having maximum dimensions of four inches by two inches by one inch and adapted to be carried and opened by a user;

b) at least two bibs contained within said portable package, wherein, when removed from said portable package, each bib is adapted to be secured around a neck of the user by a first end and a second end, each of said bibs having, 1) a releasable glue secured to the first end, and, 2) a spill envelope formed at the bottom of said bib, said envelope being open at the top; and, c) a cleansing sheet impregnated with cleansing liquids adapted to clean skin of, a user, said cleansing sheet contained within an air-tight envelope, said air-tight envelope being stored within said portable package.

2. The dispensing package according to claim 1, wherein said portable package includes a user-removable tab adapted to permit user withdrawal of an individual bib from said portable package.

3. The dispensing package according to claim 2, wherein said portable packaging is initially air-tight and is adapted to be opened by a user.

4. The dispensing package according to claim 1, further including a garbage bag contained with said portable package, said garbage bag adapted to receive user generated debris for disposal.

5. A single-use kit comprising:

a) a hand-held package having maximum dimensions of four inches by two inches by one inch and adapted to be opened by a user;

b) a bib contained within said hand-held package;

c) a sealed envelope enclosing a cleansing sheet adapted to cleanse skin of a user, said sealed envelope contained within said hand-held package; and, d) a garbage bag contained within said hand-held package.

6. The single-use kit according to claim 5, wherein said bib, when removed from said portable package, is adapted to be secured around a neck of the user by a first end and a second end, and wherein said first end of said bib includes a releasable glue adapted to releasable secure said first end to said second end of said bib.

7. The single-use kit according to claim 6, wherein said portable package is air-tight and contains an alcohol mist.

8. The single-use kit according to claim 5, a) wherein said bib includes a spill envelope formed at the bottom of said bib, said spill envelope being open at a top portion.

* * * * *